US006344310B1

(12) United States Patent
Bourdelais et al.

(10) Patent No.: US 6,344,310 B1
(45) **Date of Patent: *Feb. 5, 2002**

(54) THIN DURABLE PHOTOGRAPHIC ELEMENT

(75) Inventors: Robert P. Bourdelais, Pittsford; Peter T. Aylward, Hilton; Thaddeus S. Gula; Alphonse D. Camp, both of Rochester, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/197,735

(22) Filed: Nov. 20, 1998

(51) Int. Cl.[7] ..... G03C 1/825; G03C 1/815; G03C 11/12; G03C 1/765; G03C 1/795

(52) U.S. Cl. ..... 430/432; 430/496; 430/510; 430/533; 430/534; 430/536; 430/531

(58) Field of Search ..... 430/510, 533, 430/534, 536, 531, 496, 432

(56) References Cited

U.S. PATENT DOCUMENTS

| | | | | | |
|---|---|---|---|---|---|
| 2,732,305 | A | * | 11/1956 | Richman et al. | 430/514 |
| 3,314,794 | A | * | 4/1967 | Sawdey | 430/517 |
| 3,459,563 | A | * | 8/1969 | Terashima et al. | 430/510 |
| 3,615,557 | A | | 10/1971 | D'Cruz | |
| 3,944,699 | A | | 3/1976 | Mathews et al. | 428/220 |
| 4,187,113 | A | | 2/1980 | Mathews et al. | 430/533 |
| 4,283,486 | A | | 8/1981 | Aono et al. | 430/505 |
| 4,296,198 | A | | 10/1981 | Trautweiler | 430/961 |
| 4,341,880 | A | | 7/1982 | Toyoda et al. | 524/101 |
| 4,355,099 | A | * | 10/1982 | Trautweiler | 430/533 |
| 4,377,616 | A | | 3/1983 | Ashcraft et al. | 428/213 |
| 5,225,319 | A | * | 7/1993 | Fukazawa et al. | 430/533 |
| 5,387,501 | A | | 2/1995 | Yajima et al. | 430/533 |
| 5,393,652 | A | * | 2/1995 | Marui | 430/533 |
| 5,424,175 | A | * | 6/1995 | Ueda et al. | 430/533 |
| 5,853,965 | A | | 12/1998 | Haydock et al. | 430/536 |
| 5,866,282 | A | | 2/1999 | Bourdelais et al. | 430/536 |
| 5,874,205 | A | | 2/1999 | Bourdelais et al. | 430/536 |
| 5,955,239 | A | * | 9/1999 | Haydock et al. | 430/536 |
| 6,022,679 | A | * | 2/2000 | Kawamoto | 430/533 |

FOREIGN PATENT DOCUMENTS

| | | |
|---|---|---|
| EP | 0043552 | 1/1982 |
| EP | 0 880 065 A1 | 11/1998 |
| EP | 0 880 067 A1 | 11/1998 |
| EP | 0 880 069 A1 | 11/1998 |
| GB | 2188586 | 10/1987 |
| GB | 2 325 749 A | 12/1998 |
| GB | 2 325 750 A | 12/1998 |

* cited by examiner

*Primary Examiner*—Richard L. Schilling
(74) *Attorney, Agent, or Firm*—Paul A. Leipold

(57) ABSTRACT

The invention relates to a photographic element consisting essentially of a transparent biaxially oriented polymer sheet, at least one emulsion adhering layer, and at least one light sensitive silver halide grain containing emulsion layer adhered to said emulsion adhering layer, wherein said polymer sheet is less than 76 micrometers.

23 Claims, No Drawings

THIN DURABLE PHOTOGRAPHIC ELEMENT

FIELD OF THE INVENTION

This invention relates to photographic materials. In a preferred form it relates to photographic reflective images.

BACKGROUND OF THE INVENTION

In the formation of color paper it is known that the base paper has applied thereto a layer of polymer, typically polyethylene. This layer serves to provide waterproofing to the paper, as well as providing a smooth surface on which the photosensitive layers are formed. The formation of a suitably smooth surface is difficult, requiring great care and expense to ensure proper laydown and cooling of the polyethylene layers. The formation of a suitably smooth surface would also improve image quality, as the display material would have more apparent blackness as the reflective properties of the improved base are more specular than the prior materials. As the whites are whiter and the blacks are blacker, there is more range in between and, therefore, contrast is enhanced. It would be desirable if a more reliable and improved surface could be formed at less expense.

Prior art photographic reflective papers comprise a melt extruded polyethylene layer which also serves as a carrier layer for optical brightener and other whitener materials, as well as tint materials. It would be desirable if the optical brightener, whitener materials, and tints, rather than being dispersed in a single melt extruded layer of polyethylene, could be concentrated nearer the surface where they would be more effective optically.

Prior art photographic reflective materials typically contain cellulose fiber paper to provide support for the imaging layers. While paper is an acceptable support for the imaging layers, providing a perceptually preferred feel and look to the photograph, paper does present a number of manufacturing problems which reduce the efficiency at which photographic paper can be manufactured. Problems include those such as processing chemistry penetration into the edges of the paper, paper dust as photographic paper is slit, punched and chopped, and as loss of emulsion hardening efficiency because of the moisture gradient that exists between the photographic emulsion and the paper. It would be desirable if a reflective image could be formed without the use of cellulose paper.

In reflective photographic papers there is a need to protect the imaging layers from scratches, fingerprints, and stains. Current photographic reflective papers use a gelatin overcoat to protect the imaging layers. While the gelatin does provide some level of protection, it can easily be scratched reducing the quality of the image. Further, fingerprints or stains caused by common household liquids such as coffee, water, or fruit juice can easily stain and distort images. Wiping the images while wet causes undesirable distortion to the gelatin overcoat. Post photographic processing equipment exists that provides a protective coating to the imaging layers. Typically consumer images are individually coated or laminated with a polymer to provide protection to the image layers. A common example is photographic identification badges which are typically laminated with a clear polymer sheet to provide protection to the image on the identification badge. Post processing application of a protective layer is expensive, as it requires an additional step in the preparation of the reflective print and additional materials to provide the overcoat. It would be desirable if a reflective photographic image could be formed with a protective coating over the developed image layers that could be efficiently applied.

Typically, photographic reflective imaging layers are coated on a polyethylene coated cellulose paper. While polyethylene coated cellulose paper does provide an acceptable support for the imaging layers, there is a need for alternate support materials such as polyester or fabric. The problem with alternate, nonpaper supports is the lack of robustness in photographic processing equipment to mechanical property changes in supports. The photographic processing equipment will not run photographic materials that have significantly different mechanical properties than prior art photographic materials. It would be desirable if a reflective photographic image could be efficiently formed on alternate supports.

PROBLEM TO BE SOLVED BY THE INVENTION

There is a continuing need for photographic elements that are more durable in use and lighter weight for handling during the formation, imaging, and development process.

SUMMARY OF THE INVENTION

It is an object of the invention to overcome disadvantages of prior art and practices.

It is another object to provide photographic elements that are lightweight and thin for ease of handling during formation of the element and its imaging and development.

It is a further object to provide photographic elements that may be easily provided in finished form with a variety of substrates.

These and other objects of the invention are accomplished by a photographic element consisting essentially of a transparent biaxially oriented polymer sheet, at least one emulsion adhering layer, and at least one light sensitive silver halide grain containing emulsion layer adhered to said emulsion adhering layer, wherein said polymer sheet is less than 76 $\mu$m in thickness.

ADVANTAGEOUS EFFECT OF THE INVENTION

The invention provides a photographic element that is light in weight for ease of formation, imaging, and development, and may be easily adhered to a variety of substrates.

DETAILED DESCRIPTION OF THE INVENTION

The invention has numerous advantages over prior photographic elements. The elements of the invention are lighter in weight and thickness so that a roll of the photographic element of the same diameter will contain many more linear feet resulting in many more images per roll. The imaging element of the invention after development may be easily adhered to a variety of substrates, thereby allowing customized use of the images. It may be desirable for images that will be mailed to be adhered to a lightweight substrate, whereas images to be displayed can easily be adhered to a heavy substrate after their development. The invention further provides a wear resistant surface on the photographic element that will not be easily damaged during handling or use of the image. The wear resistant surface provides protection from fingerprinting, spills of liquids, and other environmental deleterious exposures. The paper that is utilized in mounting of the photographic images of the invention may be lower in cost, as it is not present during development of the image and not subjected to the development chemicals. The problem of dusting during slitting and chopping of photographic elements is greater minimized, as slitting and chopping takes place when there is no paper substrate present. The paper substrate is the primary source of dusting during slitting and chopping operations. The photographic elements of the invention also are less susceptible to curl, as the gelatin containing layers are sealed from humidity contamination to a great degree. Further, the biaxially oriented film provides a barrier to oxygen, as well as water vapor at the top of the print. These and other advantages will be apparent from the detailed description below.

The term as used herein, "transparent" means the ability to pass radiation without significant deviation or absorption. For this invention, "transparent" material is defined as a material that has a spectral transmission greater than 90%. For a photographic element, spectral transmission is the ratio of the transmitted power to the incident power and is expressed as a percentage as follows: $T_{RGB}=10^{-D}*100$ where D is the average of the red, green, and blue Status A transmission density response measured by an X-Rite model 310 (or comparable) photographic transmission densitometer. For this invention, "reflective" print material is defined as a print material that has a spectral transmission of 15% or less.

For the photographic element of this invention, the light sensitive emulsion layers are coated onto thin biaxially oriented polymer sheet. The sheet may be provided with an emulsion adhesion layer. This photographic element can then be printed with images using conventional exposure technology and processed using traditional photographic chemistry. When the thin transparent biaxially oriented sheet with the developed image is adhered to a reflective base material with the image layer on the bottom, a photographic reflective print material is created with the thin transparent biaxially oriented sheet providing protection to the emulsion layer. Since the biaxially oriented polymer sheet of this invention is tough and strong, the sheet will protect the emulsion from scratches, dust, and fingerprints. Further, since the biaxially oriented sheet is waterproof, it provides spill protection from liquids such as coffee, ink, and water. Protecting the emulsion has significant commercial value in that the current emulsion structure offers little protection from consumer mishandling of images.

The biaxially oriented polymer sheet is thin, preferably less than 76 $\mu$m. A thin biaxially oriented sheet has the advantage of allowing longer rolls of light sensitive silver halide coated rolls compared with thick cellulose paper based utilized in prior art materials. The thin polymer sheets also significantly reduce shipping cost of developed images, as the thin biaxially oriented polymer sheet of the invention weighs significantly less than prior art photographic paper. A thin sheet is also necessary to reduce unwanted reduction in the transparency of the biaxially oriented sheet, resulting in a cloudy image as the developed thin biaxially oriented sheet is laminated to a reflective support.

Another unique feature of this invention is the preferred addition of an antihalation layer to the imaging layers. The antihalation layer prevents unwanted secondary exposure of the silver crystals in the imaging layer as light is absorbed in the antihalation layer during exposure. The prevention of secondary exposure of the light sensitive silver crystals, will significantly increase the sharpness of the image without the use of $TiO_2$ which is commonly used in prior art reflective photographic print materials.

Surprisingly, it has also been found that ultraviolet protection materials can be added to the biaxially oriented polymer sheet to provide ultraviolet protection to the couplers used in the image layer. Traditionally, this protection for prior art materials has been provided in the gelatin overcoat layer. The incorporation of the ultraviolet protection materials in the biaxially oriented polymer sheet of this invention provides better ultraviolet protection to the imaging couplers and is lower in cost, as less ultraviolet filter materials are required in the biaxially oriented sheet than in a gelatin overcoat.

By printing and developing the image on the biaxially oriented polymer sheet and then laminating to a reflective base, this invention avoids many of the problems associated with coating the light sensitive emulsions onto a paper support. Problems such as paper dusting during slitting and punching, edge penetration of processing chemicals into the exposed paper along the slit edge, and unwanted secondary reflection are caused by the paper base. Further, for prior art photographic reflective print materials, great care must be taken to ensure that the paper base does not chemically sensitize the light sensitive image layers prior to processing. By joining the imaging layers with a reflective base after processing, a lower cost base can be used because the base material could not interact with the unexposed sensitized layers. Joining of the imaging layers of this invention with a reflective base after processing would allow many different types of base materials to be used, offering the consumer a range of options such as paper, polymer base, or fabric base.

Any suitable thin biaxially oriented polymer sheet may be used for the transparent sheet to which the imaging layers are coated. Biaxially oriented sheets are conveniently manufactured by coextrusion of the sheet, which may contain several layers, followed by biaxial orientation. Such biaxially oriented sheets are disclosed in, for example, U.S. Pat. No. 4,764,425.

Suitable classes of thermoplastic polymers for the biaxially oriented sheet include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Polyolefins particularly polypropylene, polyethylene, polymethylpentene, and mixtures thereof are preferred. Polyolefin copolymers, including copolymers of propylene and ethylene such as hexene, butene and octene are also preferred. Polypropylenes are most preferred because they are low in cost and have good strength and surface properties.

Preferred polyesters of the invention include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic, and mixtures thereof. Examples of suitable glycols include ethylene glycol, propylene glycol, butanediol, pentanediol, hexanediol, 1,4-cyclohexanedimethanol, diethylene glycol, other polyethylene glycols, and mixtures thereof. Such polyesters are well known in the art and may be produced by well-known techniques, e.g., those described in U.S. Pat. Nos. 2,465,319 and 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607; 4,459,402; and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

Addenda may be added to the biaxially oriented backside sheet to improve the whiteness of these sheets. This would include any process which is known in the art including adding a white pigment, such as titanium dioxide, barium sulfate, clay, or calcium carbonate. This would also include adding fluorescing agents which absorb energy in the ultraviolet region and emit light largely in the blue region, or other additives which would improve the physical properties of the sheet or the manufacturability of the sheet.

The coextrusion, quenching, orienting, and heat setting of these biaxially oriented sheets may be effected by any process which is known in the art for producing oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature. The quenched sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers while restraining, to some degree, the sheet against retraction in both directions of stretching.

The total thickness of the topmost skin layer beneath the imaging layers or exposed surface layer should be between 0.20 $\mu$m and 1.5 $\mu$m, preferably between 0.5 and 1.0 $\mu$m. Below 0.5 $\mu$m any inherent non-planarity in the coextruded skin layer may result in unacceptable color variation. At skin thickness greater than 1.0 $\mu$m, there is little benefit in the photographic optical properties such as image resolution. At thickness greater that 1.0 $\mu$m ,there is also a greater material volume to filter for contamination such as clumps, poor color pigment dispersion, or contamination.

Addenda may be added to the topmost skin layer to change the color of the imaging element. For photographic use, a white base with a slight bluish tinge is preferred. The addition of the slight bluish tinge may be accomplished by any process which is known in the art including the machine blending of color concentrate prior to extrusion and the melt extrusion of blue colorants that have been preblended at the desired blend ratio. Colored pigments that can resist extrusion temperatures greater than 320° C. are preferred, as temperatures greater than 320° C. are necessary for coextrusion of the skin layer. Blue colorants used in this invention may be any colorant that does not have an adverse impact on the imaging element. Preferred blue colorants include Phthalocyanine blue pigments, Cromophtal blue pigments, Irgazin blue pigments, Irgalite organic blue pigments, and pigment Blue 60.

The preferred skin material is polyethylene. Polyethylene is relatively easy to coextrude and orient and is a good adhering layer for gelatin layers. Gelatin based light sensitive silver halide imaging layers also adhere well to polyethylene after a corona discharge treatment prior to emulsion coating. This avoids the need for expensive emulsion adhesion promoting coating from being applied to obtain acceptable emulsion adhesion between the biaxially oriented sheets of this invention and the image forming layers.

The preferred thickness of the biaxially oriented sheet carrying the imaging layers of this invention is between 6 to 100 $\mu$m. Below 4 $\mu$m the web is difficult to convey through manufacturing and the photographic printers. Above 120 $\mu$m, there is little benefit to justify the additional material costs. A preferred thickness is between 6 and 76 $\mu$m.

These biaxially oriented sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photosensitive layers. Examples of this would be acrylic coatings for printability and a coating of polyvinylidene chloride for heat seal properties. Further examples include flame, plasma, or corona discharge treatment to improve printability or adhesion.

The structure of a preferred biaxially oriented sheet of the invention is as follows: There the light sensitive image layers are coated on the polyethylene layer.

Polyethylene skin with optical brightener and blue tints

Polypropylene base

As used herein, the phrase "photographic element" is a material that utilizes photosensitive silver halide in the formation of images. The photographic elements can be black-and-white, single color elements, or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating, and extrusion coating.

The silver halide emulsions utilized in this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in The Theory of the Photographic Process, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23, 113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 A1 (Yamada), and EP 0 435 355 A1 (Makino).

The photographic elements of this invention may use emulsions doped with Group VIII metals such as iridium, rhodium, osmium, and iron as described in *Research Disclosure,* September 1994, Item 36544, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black and white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 $\mu$m.

The invention may be utilized with the materials disclosed in *Research Disclosure,* 40145 of September 1997. The invention is particularly suitable for use with the materials of the color paper examples of sections XVI and XVII. The couplers of section II are also particularly suitable. The Magenta I couplers of section II, particularly M-7, M-10, M-11, and M-18 set forth below are particularly desirable.

M-7

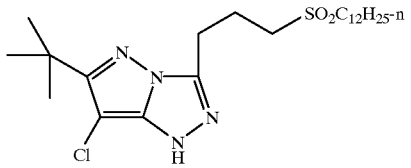

-continued

M-10

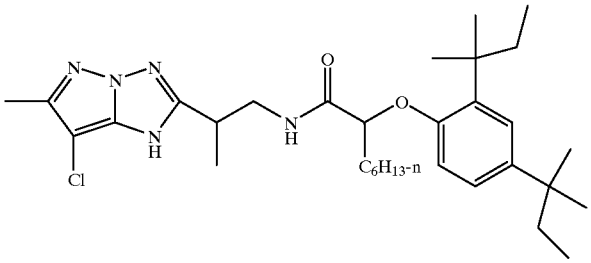

M-11

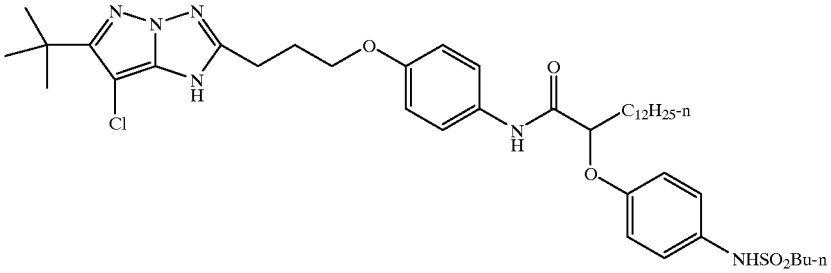

M-18

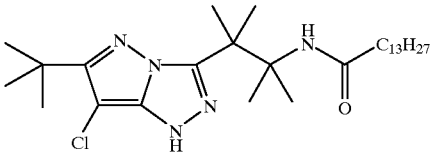

The element of the invention may contain an antihalation layer. A considerable amount of light may be diffusely transmitted by the emulsion and strike the back surface of the support. This light is partially or totally reflected back to the emulsion and reexposed it at a considerable distance from the initial point of entry. This effect is called halation because it causes the appearance of halos around images of bright objects. Further, a transparent support also may pipe light. Halation can be greatly reduced or eliminated by absorbing the light transmitted by the emulsion or piped by the support. Three methods of providing halation protection are (1) coating an antihalation undercoat which is either dye gelatin or gelatin containing gray silver between the emulsion and the support, (2) coating the emulsion on a support that contains either dye or pigments, and (3) coating the emulsion on a transparent support that has a dye to pigment a layer coated on the back. The absorbing material contained in the antihalation undercoat or antihalation backing is removed by processing chemicals when the photographic element is processed. The dye or pigment within the support is permanent and generally is not suitable for the instant invention. In the instant invention, it is preferred that the antihalation layer be formed of gray silver which is coated on the top side and removed during processing. By coating the top, the antihalation layer is easily removed, as well as allowing exposure of the material through the polymer sheet. The gray silver could be coated between the support and the emulsion layers where it would also be effective. The problem of halation is minimized by coherent collimated light beam exposure, although improvement is obtained by utilization of an antihalation layer even with collimated light beam exposure.

In order to successfully transport materials of the invention, the reduction of static caused by web transport through manufacturing and image processing is desirable. Since the light sensitive imaging layers of this invention can be fogged by light from a static discharge accumulated by the web as it moves over conveyance equipment such as rollers and drive nips, the reduction of static is necessary to avoid undesirable static fog. The polymer materials of this invention have a marked tendency to accumulate static charge as they contact machine components during transport. The use of an antistatic material to reduce the accumulated charge on the web materials of this invention is desirable. Antistatic materials may be coated on the web materials of this invention and may contain any known materials in the art which can be coated on photographic web materials to reduce static during the transport of photographic paper. Examples of antistatic coatings include conductive salts and colloidal silica. Desirable antistatic properties of the support materials of this invention may also be accomplished by antistatic additives which are an integral part of the polymer layer. Incorporation of additives that migrate to the surface of the polymer to improve electrical conductivity include fatty quaternary ammonium compounds, fatty amines, and phosphate esters. Other types of antistatic additives are hygroscopic compounds such as polyethylene glycols and hydrophobic slip additives that reduce the coefficient of friction of the web materials. An antistatic coating applied to the opposite side from the image layer or incorporated into the support's backside polymer layer is preferred. The backside is preferred because the majority of the web contact during conveyance in manufacturing and photoprocessing is on the backside. The backside is the side not carrying the emulsion containing image forming layers. The preferred surface resistivity of the antistat coat at 50% RH is less than $10^{13}$ ohm/square. A surface resistivity of the antistat coat at 50% RH is less than $10^{13}$ ohm/square and has been shown to sufficiently reduce static fog in manufacturing and during photoprocessing of the image layers.

In the following Table, reference will be made to (1) *Research Disclosure,* December 1978, Item 17643, (2) *Research Disclosure,* December 1989, Item 308119, and (3) *Research Disclosure,* September 1996, Item 38957, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, XI, XII, XIV, XV | morphology and preparation. Emulsion preparation including hardeners, coating |
| 3 | I, II, III, IX A & B | aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IX C & D | |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which encompass the ultraviolet, visible, and infrared regions of the electromagnetic spectrum, as well as with electron beam, beta radiation, gamma radiation, X ray, alpha particle, neutron radiation, and other forms of corpuscular and wavelike radiant energy in either noncoherent (random phase) forms or coherent (in phase) forms, as produced by lasers. When the photographic elements are intended to be exposed by X rays, they can include features found in conventional radiographic elements. Exposure is preferable through the transparent base material. However, exposure may be from the emulsion side. If exposed from the emulsion side, the image will be a mirror image when viewed through the transparent base after the image side is adhered to a reflective surface. However, this may be dealt with by adjustment of the exposure to reverse the exposed image such that it may be correctly viewed through the base.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) Process or other processing systems suitable for developing high chloride emulsions.

The following is a preferred structure of the photographic element of this invention:

Polypropylene
Polyethylene with blue tint and optical brightener
Light sensitive silver halide grain
Gray silver Antihalation layer A photographic image that has the perceptually preferred look and feel of prior art photographic print material can be constructed by a transparent biaxially oriented polymer sheet, an emulsion adhering layer, and at least one light sensitive silver halide grain containing emulsion layer adhered to said emulsion adhering layer, imagewise exposing said element, developing said exposed element, and adhering a substrate to the developed element. Adhering a substrate to the developed photographic element of this invention, provides a photographic print material that is durable, as the biaxially oriented polymer sheet of this invention provides protection to the sensitive developed imaging layers.

The substrate to which the photographic element is adhered can be any suitable material that supports the photographic element. Preferred materials include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. The most preferred substrate to which the photographic element is adhered is a cellulose paper base, as paper provides the look and feel of prior art reflective images and is low in cost.

To adhere the photographic element of this invention to the desired substrate, a bonding layer is required. The bonding layer must provide excellent adhesion between the photographic element and the substrate for the useful life of the image, typically 100 years. The preferred method of adhering the photographic element to the substrate is by use of an adhesive. The adhesive preferably is coated or applied to the substrate. An adhesive applied to the substrate avoids the need for a coating operation prior to bonding the photographic element to the substrate. The adhesive preferably is a pressure sensitive adhesive or heat activated adhesive. During the bonding process, the photographic element is contacted to the substrate containing the adhesive by use of a nip roller or a heated nip roll in the case of a heat activated adhesive. The preferred structure of a photographic reflective image of this invention is as follows:

Polypropylene
Polyethylene with optical brightener and blue tints
Developed image
Gray silver antihalation layer
Heat activated adhesive
Cellulose paper base The following examples illustrate the practice of this invention. They are not intended to be exhaustive of all possible variations of the invention. Parts and percentages are by weight unless otherwise indicated.

EXAMPLES

Example 1

In this example a thin, durable photographic element was constructed utilizing a two-layer biaxially oriented polyolefin sheet to which a standard photographic paper light sensitive silver halide emulsion was coated. The light sensitive silver halide emulsion was coated on the polyethylene skin. The photographic element was then printed with various images and the images were developed using standard photographic paper wet chemistry processing. To create a reflective print, the developed image on the thin biaxially oriented sheet was then laminated to a photographic grade cellulose paper using a pressure adhesive. This example will show the significant improvement in image durability and image quality compared to standard photographic reflective paper. Further, because the paper base common to reflective print materials was added after the image was formed, the expense of manufacturing and developing images on a paper base was avoided.

The biaxially oriented polyolefin sheet used in this example was a biaxially oriented, two side corona discharge treated polypropylene sheet (18 $\mu$m thick) (density=0.90 g/cc) consisting of a solid polypropylene layer (17 $\mu$m thick) and a polyethylene skin (1 $\mu$m thick). Blue pigment 60 (0.12% by weight of polyethylene) and Hostulux KS optical brightener (0.20% by weight of polyethylene) were added to the polyethylene skin.

Coating format 1 described below, which contains a gray silver used for antihalation in the SOC layer, was then coated on the polyethylene skin layer. The blue sensitizing layer was coated against the polyethylene layer.

| Coating Format 1 | Laydown mg/m$^2$ |
|---|---|
| Layer 1 Blue Sensitive Layer | |
| Gelatin | 1300 |
| Blue sensitive silver | 200 |
| Y-1 | 440 |
| ST-1 | 440 |
| S-1 | 190 |
| Layer 2 Interlayer | |
| Gelatin | 650 |
| SC-1 | 55 |
| S-1 | 160 |
| Layer 3 Green Sensitive | |
| Gelatin | 1100 |
| Green sensitive silver | 70 |
| M-1 | 270 |
| S-1 | 75 |
| S-2 | 32 |
| ST-2 | 20 |
| ST-3 | 165 |
| ST-4 | 530 |
| Layer 4 UV Interlayer | |
| Gelatin | 635 |
| UV-1 | 30 |
| UV-2 | 160 |
| SC-1 | 50 |
| S-3 | 30 |
| S-1 | 30 |
| Layer 5 Red Sensitive Layer | |
| Gelatin | 1200 |
| Red sensitive silver | 170 |
| C-1 | 365 |
| S-1 | 360 |
| UV-2 | 235 |
| S-4 | 30 |
| SC-1 | 3 |
| Layer 6 UV Overcoat | |
| Gelatin | 440 |

-continued

| Coating Format 1 | Laydown mg/m$^2$ |
|---|---|
| UV-1 | 20 |
| UV-2 | 110 |
| SC-1 | 30 |
| S-3 | 20 |
| S-1 | 20 |
| Layer 7 SOC | |
| Gelatin | 490 |
| SC-1 | 17 |
| $SiO_2$ | 200 |
| Surfactant | 2 |

APPENDIX

Y-1

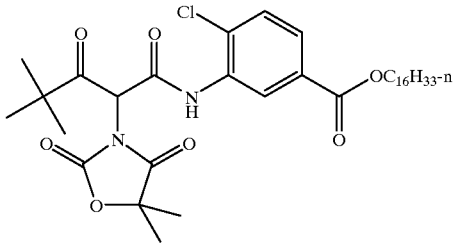

ST-1=N-tert-butylacrylamide/n-butyl acrylate copolymer (50:50)

S-1=dibutyl phthalate

SC-1

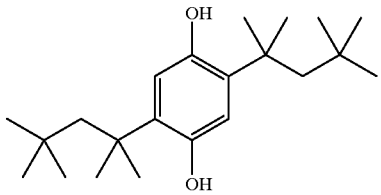

M-1

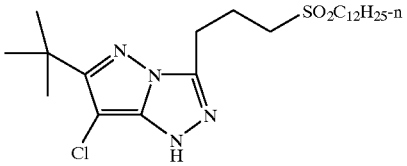

S-2 = diundecyl phthalate

ST-2

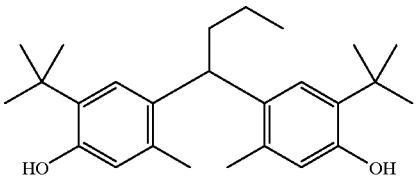

ST-3

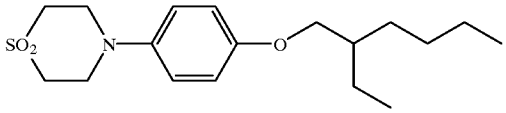

-continued

ST-4

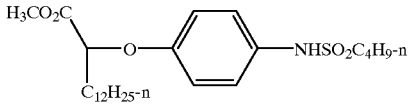

UV-1

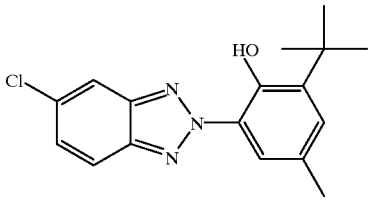

UV-2

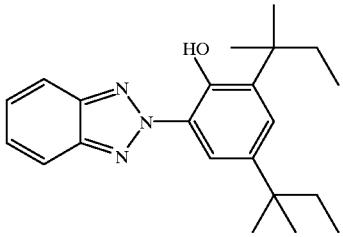

S-3=1,4-Cyclohexyldimethylene bis(2-ethylhexanoate)

C-1

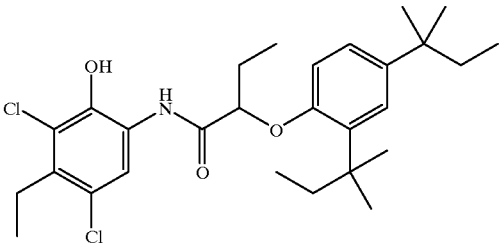

S-4=2-(2-Butoxyethoxy)ethyl acetate

Dye 1

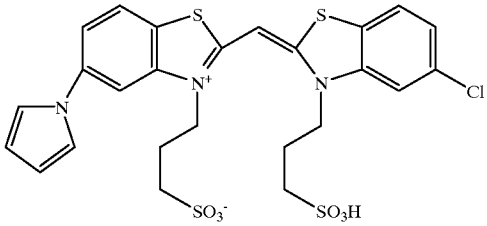

The structure of the photographic element of this example was as follows:

Polypropylene polymer

Polyethylene with blue pigment 60 and Hostalux KS

Coating format 1

The 10 cm slit rolls of light sensitive silver halide emulsion coated support of this example was printed using a conventional printer with exposure through the transparent biaxially oriented film. Several test images were optically printed on the photographic element. The printed images were then developed using standard reflective photographic wet chemistry for color paper. At this point, the photographic image was formed on a thin, biaxially oriented sheet. To construct a photographic reflective print material, the image formed on the thin biaxially oriented sheet was laminated to typical photographic grade cellulose paper.

The printed, developed images in a 10 cm slit roll were laminated using nip rollers to standard photographic paper which coated on the face side of the paper with an acrylic pressure sensitive adhesive. The wire side of the paper was laminated with BICOR 70 MLT (Mobil Chemical Co.), a one-side matte finish, one-side treated biaxially oriented polypropylene sheet (18 $\mu$m thick) (d=0.90 g/cc) consisting of a solid oriented polypropylene layer and a skin layer of a block copolymer of polyethylene and a terpolymer comprising ethylene, propylene and butylene to control the curl of the reflective image. The polypropylene skin layer was laminated to the paper with standard extrusion grade low density polyethylene.

The paper used in this example was a photographic grade paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish was added 0.2% alkyl ketene dimer, 1.0% cationic cornstarch, 0.5% polyamide-epichlorohydrin, 0.26 anionic polyacrylamide, and 5.0% $TiO_2$ on a dry weight basis. An about 46.5 lbs. per 1000 sq. ft. (ksf) bone dry weight base paper was made on a fourdrinier paper machine, wet pressed to a solid of 42%, and dried to a moisture of 10% using steam-heated dryers achieving a Sheffield Porosity of 160 Sheffield Units and an apparent density 0.70 g/cc. The paper base was then surface sized using a vertical size press with a 10% hydroxyethylated cornstarch solution to achieve a loading of 3.3 wt. % starch. The surface sized support was calendered to an apparent density of 1.04 gm/cc.

The structure of the laminated photographic element is shown below:

Polypropylene

Polyethylene with blue pigment 60 and Hostalux KS

Developed image

Acrylic pressure sensitive adhesive

Cellulose paper

Low density polyethylene

70MLT biaxially oriented polyolefin sheet

The color photographic image laminated to the cellulose paper of this example has many advantages over prior art reflective photographic papers. The elements of the invention are lighter in weight and thickness compared to prior art photographic paper. A roll of light sensitive silver halide coated thin biaxially oriented sheets of the same diameter will contain 800% more images per roll as the thickness of the invention is 90% than prior art photographic paper. Further, because the imaging materials of the invention are light and thin, they can be mailed at a much lower cost compared to prior art photographic paper. The imaging element of the invention after development may be easily adhered to a cellulose paper base after development of images avoiding problems common to cellulose paper such as the edge penetration of processing chemistry and paper dusting in the photographic printer.

The invention further provides a wear resistant surface on the photographic element that will not be easily damaged during handling or use of the image, as the image forming layers are below a layer of biaxially oriented polymer. The wear resistant surface of the invention provides protection from fingerprinting, spills of liquids, and other environmental deleterious exposures. Prior art photographic papers, because they typically use cross-linked gelatin as a protective overcoating, cannot resist fingerprint oils, spills of liquids, and scratches.

The photographic elements of the invention also are less susceptible to curl, as the gelatin containing layers are sealed from humidity contamination to a great degree. Further, the biaxially oriented film provides a barrier to oxygen, as well as water vapor at the top of the print, which will extend the life of oxygen sensitive color couplers.

The invention has been described in detail with particular reference to certain preferred embodiments thereof, but it will be understood that variations and modifications can be effected within the spirit and scope of the invention.

What is claimed is:

1. A photographic element consisting essentially of a coextruded and oriented transparent biaxially oriented polymer sheet comprising a transparent polymer layer and at least one emulsion adhering layer, at least one light sensitive silver halide grain containing emulsion layer adhered to said emulsion adhering layer, and an antihalation layer overlaying said at least one light sensitive silver halide grain containing layer, wherein said polymer sheet is less than 100 $\mu$m in thickness and wherein said transparent polymer sheet comprises polypropylene and said ultraviolet absorbers, and said emulsion adhering layer comprises polyethylene.

2. The photographic element of claim 1 wherein the thickness of said polymer sheet is between 6 and 76 $\mu$m.

3. The photographic element of claim 1 wherein said emulsion adhering layer further comprises colorant materials.

4. The photographic element of claim 3 wherein said transparent biaxially oriented polymer sheet has a thickness between 6 and 76 $\mu$m.

5. The photographic element of claim 1 wherein said antihalation layer comprises gray silver.

6. A method of providing a photographic image comprising providing a photographic element consisting essentially of a coextruded and oriented transparent biaxially oriented polymer sheet comprising a transparent polymer layer and an emulsion adhering layer, at least one light sensitive silver halide grain containing emulsion layer adhered to said emulsion adhering layer, and an antihalation layer overlaying said at least one light sensitive silver halide grain containing layer, imagewise exposing said element, developing said exposed element, and adhering a reflective substrate to the developed element wherein said polymer sheet is less than 100 $\mu$m in thickness and wherein said transparent polymer layer comprises polypropylene and ultraviolet absorbers, said emulsion adhering layer comprises polyethylene, and said antihalation layer is removed during processing.

7. The method of claim 6 wherein said exposure is through the transparent biaxially oriented polymer sheet.

8. The method of claim 6 wherein said substrate comprises a substrate bearing an adhesive layer.

9. The method of claim 8 wherein said substrate bearing an adhesive has a pressure sensitive adhesive that has a release liner that is removed from the adhesive layer prior to adhering said substrate bearing an adhesive layer to said element.

10. The method of claim 8 wherein said substrate bearing adhesive layer has a heat setting adhesive that is heated to bond to the element after it is brought into contact with said element.

11. The method of claim 8 wherein said substrate has a layer of adhesive applied onto its surface prior to being bonded to said photographic element.

12. The method of claim 8 wherein said substrate comprises paper.

13. The method of claim 8 wherein said substrate comprises a sheet material selected from the group consisting of polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers.

14. The method of claim 6 wherein said substrate is adhered to the side of said element bearing the emulsion layer.

15. The method of claim 6 wherein said transparent polymer sheet is between 6 and 76 $\mu$m thick.

16. A method of providing a photographic image comprising providing a photographic element consisting essentially of a coextruded and oriented transparent biaxially oriented polymer sheet comprising a transparent polymer layer and an emulsion adhering layer, at least one light sensitive silver halide grain containing emulsion layer adhered to said emulsion adhering layer and an antihalation layer overlaying said emulsion layer, imagewise exposing said element, developing said exposed element, and adhering a reflective substrate to the developed element wherein said polymer sheet is less than 100 $\mu$m in thickness and said antihalation layer is removed during processing and said polymer sheet comprises ultraviolet absorbers.

17. The method of claim 16 wherein said exposure is through the transparent biaxially oriented polymer sheet.

18. The method of claim 16 wherein said substrate comprises a substrate bearing an adhesive layer.

19. The method of claim 18 wherein said substrate bearing an adhesive has a pressure sensitive adhesive that has a release liner that is removed from the adhesive layer prior to adhering said substrate bearing an adhesive layer to said element.

20. The method of claim 18 wherein said substrate bearing adhesive layer has a heat setting adhesive that is heated to bond to the element after it is brought into contact with said element.

21. The method of claim 16 wherein said substrate comprises a sheet material selected from the group consisting of polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers.

22. The method of claim 16 wherein said substrate is adhered to the side of said element bearing the emulsion layer.

23. The method of claim 22 wherein said transparent polymer sheet is between 6 and 76 $\mu$m thick.

* * * * *